US005861717A

United States Patent [19]

Begemann et al.

[11] Patent Number: 5,861,717

[45] **Date of Patent: *Jan. 19, 1999**

[54] LIGHTING SYSTEM FOR CONTROLLING THE COLOR TEMPERATURE OF ARTIFICIAL LIGHT UNDER THE INFLUENCE OF THE DAYLIGHT LEVEL

[75] Inventors: Simon H. A. Begemann; Ariadne D. Tenner; Gerrit J. Van Den Beld, all of Eindhoven, Netherlands

[73] Assignee: U.S. Philips Corporation, New York, N.Y.

[ * ] Notice: The term of this patent shall not extend beyond the expiration date of Pat. No. 5,721,471.

[21] Appl. No.: 911,868

[22] Filed: Aug. 15, 1997

Related U.S. Application Data

[63] Continuation of Ser. No. 609,367, Mar. 1, 1996, Pat. No. 5,721,471.

[30] Foreign Application Priority Data

Mar. 10, 1995 [EP] European Pat. Off. ..... 95200588

[51] Int. Cl.[6] ..... H05B 37/02

[52] U.S. Cl. ..... 315/158; 315/154; 250/214 AL

[58] Field of Search ..... 315/158, 154, 315/151, 152, 153, 157, 159; 250/214 AL, 205

[56] References Cited

U.S. PATENT DOCUMENTS

| | | | |
|---|---|---|---|
| 4,647,763 | 3/1987 | Blake | 250/214 AL |
| 4,701,669 | 10/1987 | Head et al. | 315/155 |
| 5,019,747 | 5/1991 | Morita et al. | 315/157 |
| 5,250,799 | 10/1993 | Werner | 250/214 AL |
| 5,262,701 | 11/1993 | Derra et al. | 315/224 |
| 5,357,170 | 10/1994 | Luchaco et al. | 315/159 |
| 5,721,471 | 2/1998 | Begemann et al. | 315/158 |

*Primary Examiner*—Don Wong
*Assistant Examiner*—Haissa Philogene
*Attorney, Agent, or Firm*—Edward Blocker

[57] ABSTRACT

A lighting system having at least one light source for supplying artificial light and a control unit for controlling the light source. The light source is of the type having an adjustable color temperature. The control unit is provided with a control signal form a signal from a signal generator. The signal generator is dependent on the mean daylight level. The control unit is arranged to adjust the color temperature of the light source in dependence on a predetermined relationship between the mean daylight level and the color temperature of the artificial light. The lighting system will provide artificial light which will when the daylight level, as measured on an office desk, increases from approximately 400 lux to approximately 800 lux, increase the color temperature from approximately 3300 K to approximately 4300 K.

10 Claims, 3 Drawing Sheets

LIGHTING SYSTEM FOR CONTROLLING THE COLOR TEMPERATURE OF ARTIFICIAL LIGHT UNDER THE INFLUENCE OF THE DAYLIGHT LEVEL

This is a continuation of application Ser. No. 08/609,367, filed Mar. 1, 1996 now U.S. Pat. No. 5,721,471.

BACKGROUND OF THE INVENTION

The invention relates to a lighting system, comprising at least one light source for supplying artificial light and a control unit for controlling the light source, the control unit comprising means for forming a control signal which is dependent on the daylight level. The invention also relates to a control unit for use in such a lighting system.

A lighting system of this kind is widely used, notably for the lighting of office buildings. In known systems the means for forming a control signal which is dependent on the daylight level generally comprise a light sensor for measuring the daylight level. The control unit is then arranged to switch on the artificial light when the measured daylight level drops below a predetermined minimum or, conversely, to switch off the artificial light when the measured daylight level exceeds a predetermined maximum. Systems of this kind are also known as street lighting systems. It is known in particular that in office lighting systems the control unit adjusts the intensity of the artificial light mainly inversely proportionally to the level of the daylight.

A large-scale study has revealed that for 85% of the office workers good lighting highly contributes to office comfort [Harris Louis: Office lighting, comfort and productivity-how the workers feel. Lighting Design and Application No. 10, July 1980]. It is known that in this respect light plays a visual as well as a non-visual role. As regards the visual role, it is important, evidently, that the appropriate amount and type of lighting are used to perform a given task. As regards the non-visual role it is known that various processes within the human body are influenced by light. Examples of such processes are the 24-hour rhythm (circadian rhythm) of the sleeping-activity cycle and of the production of some hormones. The non-visual aspects of light, consequently, have an indirect effect on the performance and effectiveness of humans.

The foregoing emphasizes the important role of light. In many environments, such as offices, factories but also living rooms, light is formed by a combination of incident daylight and added artificial light. In many cases the daylight cannot be influenced, or only to a limited extent, by the user, for example by opening or closing a blind. This makes control of the artificial light all the more important.

It is an object of the invention to provide a lighting system of the kind set forth which takes into account human preferences.

To this end, the lighting system in accordance with the invention is characterized in that the light source is of the type having an adjustable colour temperature, and the control unit is arranged to adjust the colour temperature of the light source in dependence on a predetermined relationship between the daylight level and the colour temperature of the artificial light.

The invention is based on the insight, gained by tests, that test persons demonstrate a preference for a given colour temperature of the artificial light, which colour temperature is dependent on the intensity of the incident daylight. For example, by utilizing a light sensor for measuring the level of the incident daylight, the control unit can adjust the colour temperature of the artificial light in dependence on the measured daylight level.

An embodiment of the lighting system in accordance with the invention is characterized in that the means for forming the control signal comprise a day calendar unit for determining the day of the year and are arranged to form the control signal in dependence on a predetermined relationship between the day of the year and the mean daylight level. In a simple version of this embodiment the daylight level is estimated while utilizing a day calendar unit for determining the day of the year. On the basis of a predetermined relationship between the day of the year and the mean daylight level, the daylight level can be estimated so as to be used to adjust the colour temperature.

A less simple version of said embodiment is characterized in that the means for forming the control signal also comprise a clock and are arranged to form the control signal in dependence on a predetermined relationship between on the one hand the day of the year and the time of day and on the other hand the mean daylight level. As a result of the use of a clock, the daylight level at any time of day can be simply estimated better, resulting in a better adjustment of the colour temperature of the artificial light.

An even more advanced version of said embodiment is characterized in that the means for forming the control signal also comprise a light sensor for measuring the actual daylight level, that the control unit stores at least two different, predetermined relationships between the daylight level and the colour temperature, and that the control unit is arranged to select one of said relationships in dependence on the measured actual daylight level. For example, by storing different relationships for different types of weather, such as clear, overcast or mixed, and by selecting the most appropriate relationship on the basis of the measured daylight level, an even better adjustment of the colour temperature of the artificial light is achieved.

An embodiment of the lighting system in accordance with the invention is characterized in that the control unit stores at least two different, predetermined relationships between the daylight level and the colour temperature, and that the control unit comprises a first control member which is arranged to select one of said relationships. Human tastes, generally speaking, are very diverse. This also becomes apparent in the form of different preferences for light settings. Some people prefer "warmer" light whereas others prefer "cooler" light. In order to satisfy these various preferences in a simple manner, the latter embodiment of the system offers the user a selection from at least two predetermined relationships.

An embodiment of the lighting system in accordance with the invention is characterized in that the control unit comprises modification means which are arranged to modify the predetermined relationship between the daylight level and the colour temperature. In order to comply even better with the user's preferences, this embodiment of the system offers the possibility of modification of the predetermined relationship. Like in the foregoing embodiment, on the one hand this enables optimization of the control system for a given office building, for example taking into account the situation and general layout of the building. On the other hand, if the offices can be individually controlled, per office a relationship can thus be adapted to the individual wishes of the user. An improved version of this embodiment of the lighting system in accordance with the invention is characterized in that the control unit comprises a second control member which is arranged to readjust the adjusted colour temperature and to operate the modification means. As opposed to the foregoing embodiments, where the user influences the control only indirectly by selection or modification of a relationship, in this embodiment the user can readjust the colour temperature directly. On the basis of this readjustment, the system also modifies the desired relationship between the daylight level and the colour temperature. The individual preferences of persons can thus be satisfied even better.

An embodiment of the lighting system in accordance with the invention is characterized in that the predetermined relationship between the daylight level and the colour temperature of the artificial light, adjusted by the user, constitutes mainly an increase of the colour temperature as the daylight level increases. Tests have shown that a positive correlation exists between the daylight level and the colour temperature of the artificial light, so that a lighting system satisfying these requirements can satisfy the wishes of the average user.

An embodiment of the lighting system in accordance with the invention is characterized in that the predetermined relationship between the daylight level and the colour temperature of the artificial light means that when the daylight level, measured on an office desk, increases from a proximately 400 lux to approximately 1800 lux, the colour temperature increases from approximately 3300 K to approximately 4300 K. Tests have demonstrated that such a relationship is a suitable representation of the wishes of the average test person. A lighting system utilizing such a relationship as a basis can highly satisfy user wishes concerning the adjustment of the colour temperature.

These and other aspects of the invention will be apparent from and elucidated with reference to the embodiments described hereinafter.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
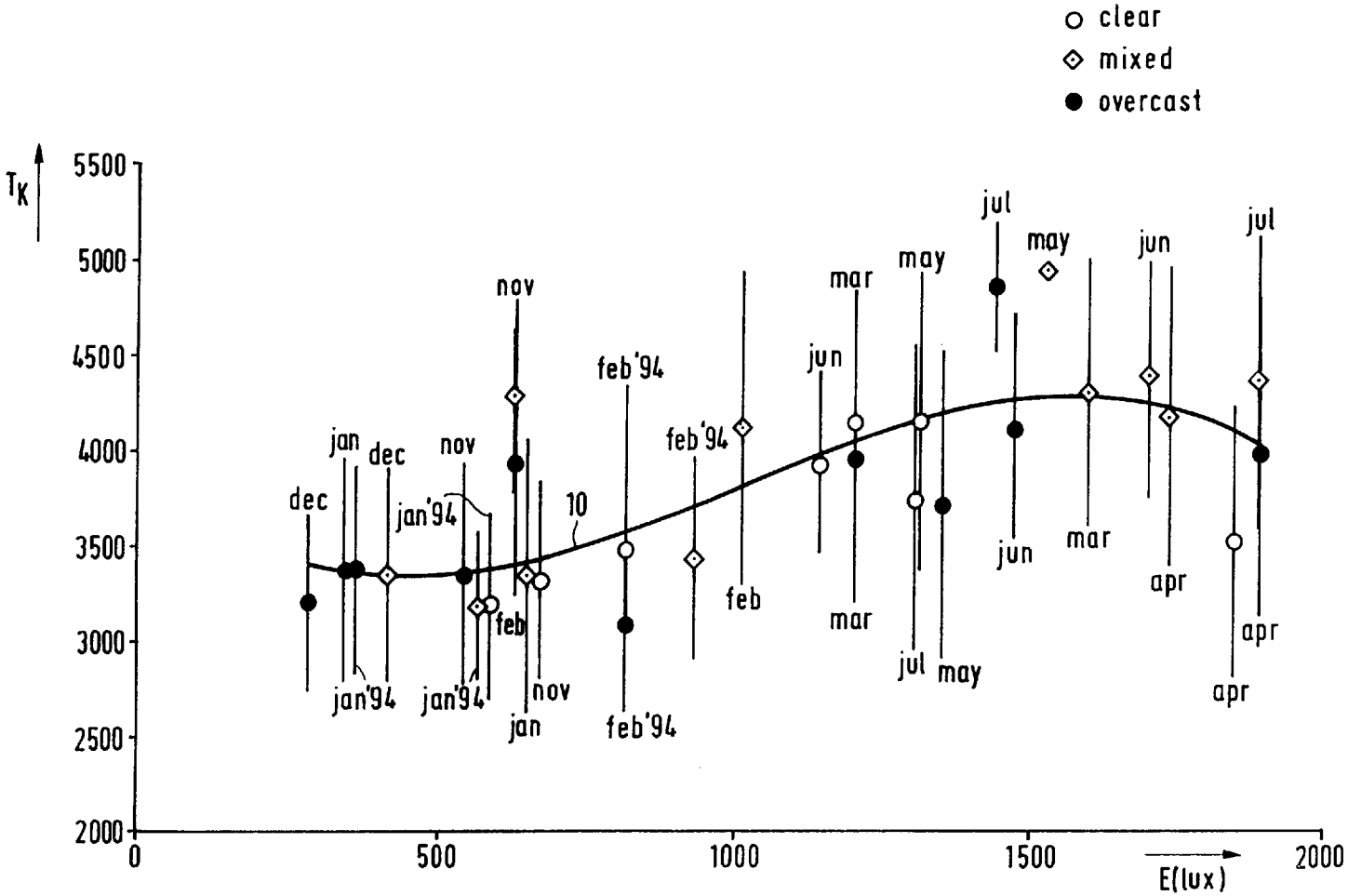
FIG. 1 illustrates the relationship between the mean daylight level and the mean colour temperature artificial light as chosen by test persons.

FIG. 1 illustrates the results of tests carried out to determine the preferences of humans in respect of the settings of artificial light in an office environment. Measurements were performed in two identical offices for a period of 14 months. The preferred settings were measured for approximately 100 test persons, each of whom used an office for at least one day. The offices were furnished as normal offices in which the test persons carried out their normal work. The test persons could adjust the intensity as well as the colour temperature for the artificial light. The intensity could be adjusted between approximately 400 and 2000 lux; the colour temperature could be adjusted between approximately 2700 and 2400 Kelvin (K). The level and the colour temperature of the incident daylight were also measured. The overall light intensity (daylight and artificial light) was measured on a horizontal desk top. A similar measurement was carried out in a scale model in which daylight was incident but no artificial light was used. After calibration the daylight level in the office was determined from the last measurement. In order to enable reliable determination of the effect of daylight on the preferred settings, the artificial light was switched off a number of times a day, after which the test persons had to adjust the artificial light again.

The tests demonstrated that the test persons only slightly readjusted the intensity of the artificial light under the influence of the incident daylight. On average approximately 800 lux of artificial light was added, regardless of the level of the daylight. In the case of very strong daylight, for example an incidence of more 2000 lux on the desk, often the artificial light was not switched off but the intensity was increased. With a very high daylight level the intensity of the artificial light was decreased, however, by partly closing the blinds.

Surprisingly it was found that the test persons did readjust the colour temperature of the artificial light to a high degree under the influence of the incident daylight. It was found notably that the level of incident light played an important part in adjusting the colour temperature of the artificial light. The colour temperature of the daylight was not found to play an important part. Therefore, from the measurements a relationship can be derived between the mean level of the incident daylight and the colour temperature of the artificial light as chosen by the test persons.

FIG. 1 illustrates this relationship. The graph shows the measurements performed during the period from January 1993 till February 1994. In order to gain insight also as regards the setting of the colour temperature as a function of the type of weather and as a function of the period of the year, the individual measurements are represented in the form of groups. For each day for which measurements were carried out the weather type is characterized as being clear, overcast or mixed. The measurements performed for a whole month are combined per type of weather. In principle this results in three bars per month, the centre of the bar representing the average value of the colour temperatures chosen whereas the height of the bar represents twice the standard deviation, thus constituting an indication as regards the differences in the personal preferences and the spread in the settings.

In FIG. 1 the mean contribution of the daylight to the luminous intensity E in lux is plotted along the horizontal axis and the mean colour temperature $T_k$ of the artificial light in Kelvin is plotted along the vertical axis. It can be deduced from the measurements that as the daylight level is higher, the desired colour temperature of the artificial light also increases. It appears notably that as the daylight level increases from approximately 400 lux to approximately 1800 lux, the colour temperature increases from approximately 3300 K to approximately 4300 K. In many lighting systems a linearly increasing relationship between the daylight level and the colour temperature of the artificial light will suitably satisfy the wishes of the average person. Many people do not appreciate an excessively high colour temperature, for example of more than 4200 K. As can be deduced from FIG. 1, the desired colour temperature hardly increases beyond the point where it reaches approximately 4000 K at a daylight level of 1500 lux. In some cases it may even occur that the desired colour temperature decreases when the daylight level rises beyond approximately 1800 lux. A lighting system utilizing a relationship as represented by the curve 10 in FIG. 1 can satisfy the wishes of the average person even better.

A system of this kind can be used for artificial illumination of spaces where people stay, such as offices, factory halls, schools and public buildings. Daylight can also enter these premises, for example through windows or skylights. The premises are not represented in the Figures.

Figure 2:
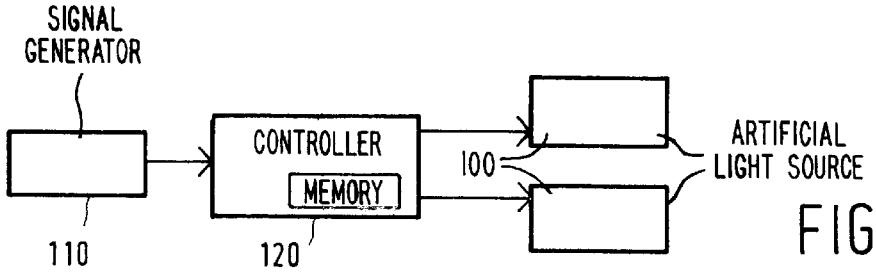
FIG. 2 shows a general block diagram of a lighting system in accordance with the invention.

FIG. 2 shows a general block diagram of a lighting system in accordance with the invention which is based on the above insights. The lighting system comprises at least one light source 100 for the supply of artificial light. This light source is of a type with an adjustable colour temperature. The light source is used to illuminate the relevant parts of the room, such as the desk, the table and the walls. A light source having an adjustable colour temperature can be formed, for example by combining at least two dimmable light sources, each of which has a fixed, different colour temperature. Lamps which can be suitably combined are the Philips Lighting Company fluorescent lamps of the type HFD (High Frequency Dimmable) TLD. The colour temperature can be adjusted through a very wide range when a lamp having a fixed colour temperature of 2700 K, such as the TLD colour 82 is combined, with a lamp having a fixed colour temperature of 6500 K, such as the TLD colour 86. The colour temperature is adjusted by changing the flux ratio of the lamps, preferably the total flux being maintained. It will be evident that adjustability through a smaller range, for example from 3500 K to 4000 K, already suffices for many applications. Evidently, the combination of lamps can be assembled so as to form one lamp. Other forms of light sources having an adjustable colour temperature are disclosed in the Patent Applications EP-A 439861, EP-A 439862, EP-A 439863, EP-A 439864, EP-A 504967 and DE-A 4200900.

The lighting system also comprises means 110 for forming a control signal (i.e., signal generator) which is dependent on the daylight level. The means 110 may comprise, for example a light sensor which is known per se and signal processing means for converting the signal supplied by the light sensor into a control signal which is suitable for the remainder of the lighting system. The light sensor is preferably arranged in such a manner that it measures a representative part of the incident light. Photosensitive resistors and photosensitive diodes are known examples of light sensors.

The lighting system also comprises a control unit 120 (i.e., controller) for controlling the light source (sources). The control unit is arranged to adjust the colour temperature of the light source in dependence on a predetermined relationship between the daylight level and the colour temperature of the artificial light. The relationship is preferably as described above.

The Philips Electronics control unit 800-IFS is an example of a unit suitable for implementation in accordance with the invention. The program of this control unit can be adapted so as to execute the described control operations, the relationship between the daylight level and the colour temperature being stored in a ROM (or RAM) 115 of the control unit.

Figure 3:
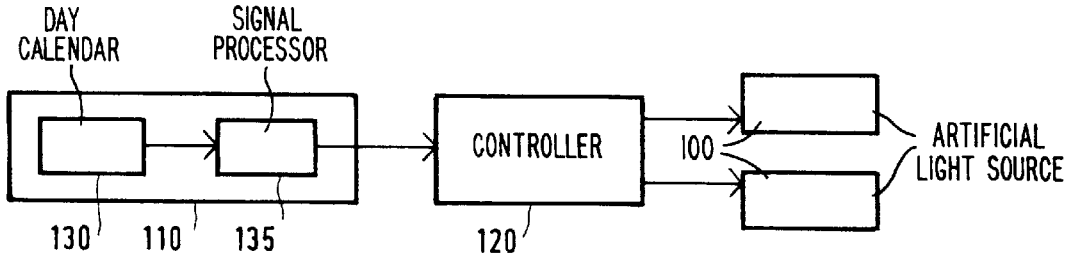
FIG. 3 shows a block diagram of a first embodiment of the system shown in FIG. 2.

FIG. 3 shows a block diagram of an embodiment of the lighting system in accordance with the invention in which the means 110 for forming a control signal which is dependent on the daylight level comprise a day calendar unit 130 for determining the day of the year. The means 110 also comprise signal processing means 135 (i.e., signal processor) which are arranged to form the control signal in dependence on a predetermined relationship between the day of the year and the mean daylight level. Day calendar units suitable for determining the day of the year are generally known. When use is made of a control unit 120 comprising a microcontroller, the day calendar unit 130 can be advantageously combined with the clock functions of the microcontroller. A further advantage can be achieved by combining the signal processing means 135 with the control unit 120. Thus, a control unit can be used which is arranged to adjust the colour temperature of the light source in dependence on a predetermined relationship between the day of the year and the colour temperature of the artificial light (a combination of on the one hand the relationship between the day of the year and the mean daylight level and on the other hand the relationship between the mean daylight level and the colour temperature of the artificial light).

Figure 4:
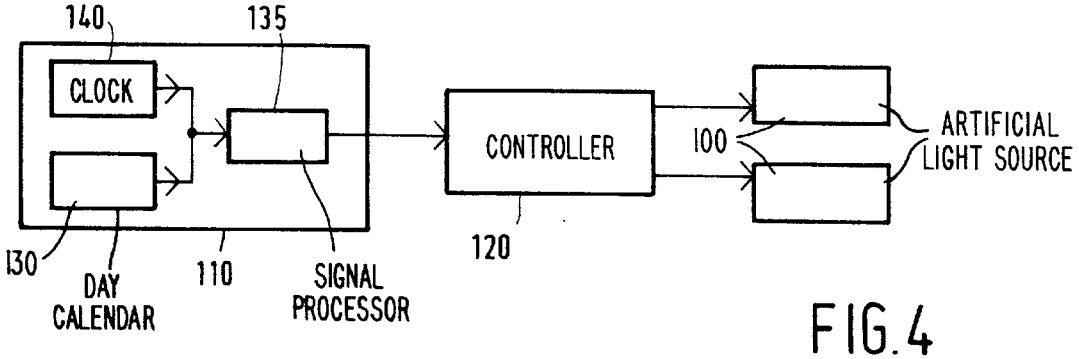
FIG. 4 shows a block diagram of a second embodiment.

FIG. 4 shows a block diagram of a further embodiment in which the means 110 for forming a control signal which is dependent on the daylight level also comprise a clock 140 for determining the time of day. The signal processing means 135 are arranged to form the control signal in dependence on a predetermined relationship between on the one hand the day of the year and the time of day and on the other hand the mean daylight level. A clock suitable for determining the time of day is generally known. When use is made of a control unit 120 comprising a microcontroller, the clock functions of the microcontroller can be advantageously used for the clock 140. A further advantage can then be achieved by combining the signal processing means 135 with the control unit 120. Thus, a control unit can be used which is arranged to adjust the colour temperature of the light source in dependence on a predetermined relationship between on the one hand the day of the year and the time of day, and on the other hand the colour temperature of the artificial light.

Figure 5:
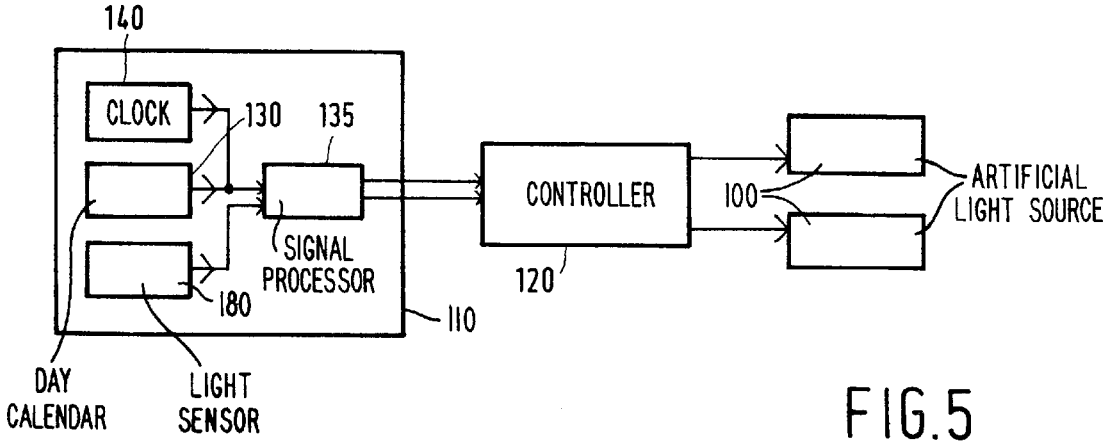
FIG. 5 shows a block diagram of a third embodiment.

FIG. 5 shows a block diagram of a further embodiment in which the means 110 for forming a control signal which is dependent on the daylight level also comprise a light sensor 180 for measuring the actual daylight level. The signal processing means 135 are also arranged to convert the signal supplied by the light sensor into a second control signal which is suitable for the remainder of the lighting system. The control unit 120 stores at least two different, predetermined relationships between the daylight level and the colour temperature. For example, three relationships, corresponding to the weather types "clear", "overcast" and "mixed" as shown in FIG. 1, can be stored. The control unit 120 is arranged to select one of said relationships in dependence on the second control signal.

Figure 6:
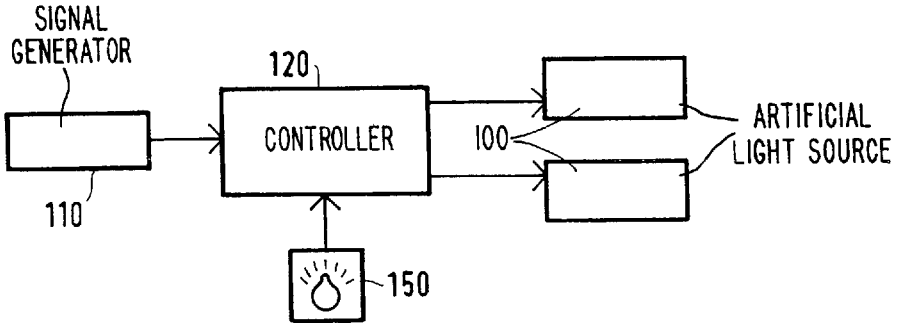
FIG. 6 shows a block diagram fourth embodiment.

FIG. 6 shows a block diagram of an embodiment of the device in accordance with the invention in which the control unit 120 stores at least two different, predetermined relationships between the daylight level and the colour temperature. The control unit 120 also comprises a first control member 150 (i.e., selector) which is arranged to select one of said relationships. The control member 150 may be provided, for example with a knob, the position of the knob indicating the selected relationship. It is alternatively possible to provide the control unit 120 with a display screen for displaying the relationships to be selected, the control member 150 then being provided with a keyboard or a mouse. Evidently, the control member 150 may also be provided with a remote control or a switch.

Figure 7:
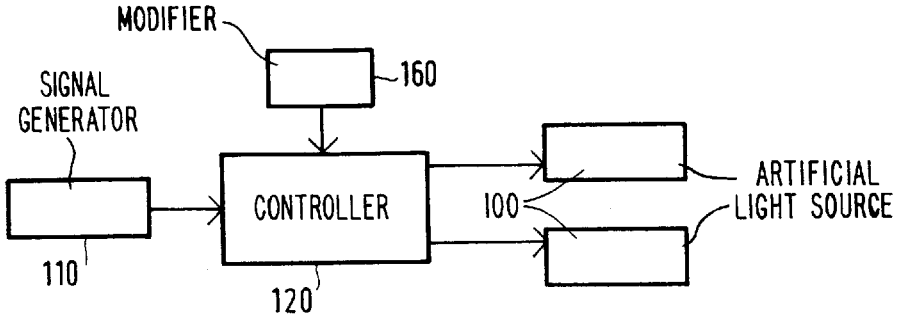
FIG. 7 shows a block diagram of a fifth embodiment.

FIG. 7 shows a block diagram of a further embodiment of the device in accordance with the invention in which the control unit 120 comprises modification means 160 (i.e., modifier) which are arranged to modify the predetermined relationship between the daylight level and the colour temperature. Numerous ways are known for modifying such relationships. For example, in this respect the same increase or decrease of the colour temperature may be considered for each daylight level. If the relationship is stored in a ROM or a RAM of the control unit, it suffices to store an offset in a permanent memory such as an EEPROM. An alternative way of modification consists in modifying, notably if the relationship is linear, the colour temperature at the starting point (for example, 400 lux, 3300 K) and/or the end point (for example, 200 lux, 4300 K). It then suffices to store the colour temperature of the starting and end points in the permanent memory.

In the above two embodiments an additional advantage is achieved by utilizing light sources which can be adjusted through a very wide range of, for example from 2700 K to 5400 K and allow for such a modification or selection of relationships that the entire range of the light sources can be utilized. Personal preferences for "warmer" or "colder" light can thus be complied with even better.

Figure 8:
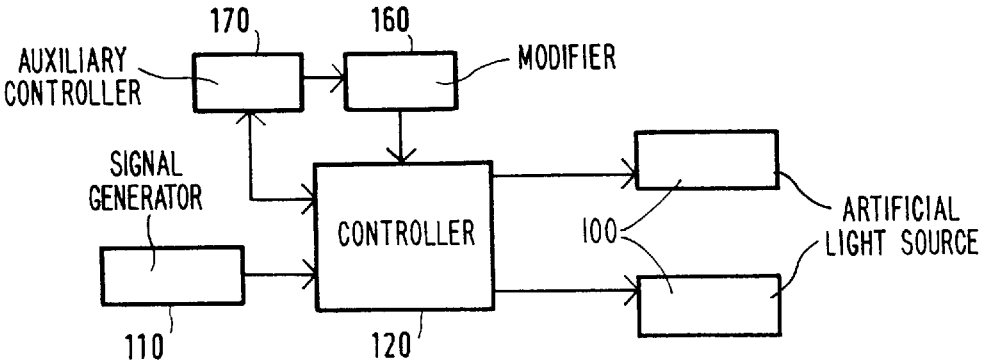
FIG. 8 shows a block diagram of a sixth embodiment.

FIG. 8 shows a block diagram of a further embodiment of the lighting system in accordance with the invention in which the control unit comprises a second control member 170. The second control member 170 (auxilliary controller) is arranged to readjust the adjusted colour temperature and to operate the modification means 160. The second control member 170 may be of the same type as the first control member 150. The second control member is preferably provided with a dimmer for simple readjustment of the colour temperature.

Evidently, the lighting system in accordance with the invention can be combined with a lighting system in which the intensity of the artificial light is controlled in dependence on the daylight level. Such a lighting system also comprises at least one light source of the type with an adjustable intensity. In addition, the system comprises a control unit which is arranged to adjust the intensity of the light source in dependence on a predetermined relationship between the daylight level and the intensity of the artificial light. In such a lighting system it is advantageous to use a light source which is adjustable in respect of intensity as well as colour temperature. The control unit can then be arranged to control the intensity as well as the colour temperature of the artificial light in dependence on the daylight level.

For the control of lighting it is important to take into account human feelings. Human feelings can be readily represented in mainly quantitative rules, such as "if it becomes darker outside, then more and warmer artificial light". A rule-oriented control unit, such as a "fuzzy logic" controller, therefore, is extremely suitable for use in the lighting system in accordance with the invention. Fuzzy logic control units offer major advantages, notably in advanced embodiments of the lighting system in accordance with the invention. This holds, for example, for lighting systems which also take into account seasons or the weather conditions, such as clear or overcasts skies, shrouds and changing cloudiness, in order to arrive at a given setting of the colour temperature or the intensity of the artificial light. Such a system for controlling the light intensity is described in the non-prepublished Application EP-A-0 652 692 (PHF 93.577). It is extremely advantageous to combine said known system with the system in accordance with the invention.

It will thus be seen that the objects set forth above, and those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense. It is also to be understood that the following claims are intended to cover all the generic and specific features of the invention herein described, and all statements of the scope of the invention which, as a matter of language, might be said to fall therebetween.

We claim:

1. A lighting system, comprising at least one light source for supplying artificial light and a control unit for controlling the light source, the control unit comprising means for forming a control signal which is dependent on a daylight level, characterized in that the light source is of the type having an adjustable colour temperature, and the control unit is arranged to adjust the colour temperature of the light source in dependence on a predetermined relationship between the daylight level and the colour temperature of the artificial light.

2. The lighting system as claimed in claim 1, characterized in that the control unit comprises modification means which are arranged to modify the predetermined relationship between the daylight level and the colour temperature.

3. The lighting system as claimed in claim 2, characterized in that the control unit comprises a second control member which is arranged to readjust the adjusted colour temperature and to operate the modification means.

4. The lighting system as claimed in claim 2, in which the color temperature and daylight level substantially increase together.

5. The lighting system as claimed in claim 3, in which the color temperature and daylight level substantially increase together.

6. The lighting system as claimed in claim 1, characterized in that when the daylight level, measured on an office desk, increases from approximately 400 lux to approximately 800 lux, the colour temperature increases from approximately 3300 K to approximately 4300 K.

7. The lighting system as claimed claim 1, characterized in that the control unit stores at least two different, predetermined relationships between the daylight level and the colour temperature, and that the control unit comprises a first control member which is arranged to select one of said relationships.

8. The lighting system as claimed in claim 1, in which the color temperature and daylight level substantially increase together.

9. The lighting system as claimed claim 8, characterized in that the control unit stores at least two different, predetermined relationships between the daylight level and the colour temperature, and that the control unit comprises a first control member which is arranged to select one of said relationships.

10. The lighting system as claimed in claim 8, characterized in that when the daylight level, measured on an office desk, increases from approximately 400 lux to approximately 800 lux, the colour temperature increases from approximately 3300 K to approximately 4300 K.

* * * * *